US006021958A

United States Patent [19]

Smith

[11] Patent Number: 6,021,958

[45] Date of Patent: Feb. 8, 2000

[54] SYNTHETIC RAILROAD TIE

[76] Inventor: Douglas L. Smith, 593 S. 900 East, Layton, Utah 84041

[21] Appl. No.: 09/019,170

[22] Filed: Feb. 5, 1998

[51] Int. Cl.[7] ..... E01B 3/00

[52] U.S. Cl. ..... 238/83; 238/84

[58] Field of Search ..... 238/83, 84, 85, 238/91, 92, 117

[56] References Cited

U.S. PATENT DOCUMENTS

| | | | |
|---|---|---|---|
| 1,192,739 | 7/1916 | Blair | 238/91 |
| 1,268,235 | 6/1918 | Gould | 238/84 |
| 2,611,545 | 9/1952 | Bartlett | 238/84 |
| 3,598,312 | 8/1971 | Hamilton | 238/84 |
| 3,893,619 | 7/1975 | Bruner | 238/83 |
| 4,108,377 | 8/1978 | Potter | 238/84 |
| 4,150,790 | 4/1979 | Potter | 238/91 |
| 5,799,870 | 9/1998 | Bayer | 238/84 |

FOREIGN PATENT DOCUMENTS

| | | | |
|---|---|---|---|
| 861929 | 1/1971 | Canada | 238/84 |

*Primary Examiner*—Mark T. Le

[57] ABSTRACT

A synthetic railroad tie is provided including a plurality of solid ties each constructed from plastic and having a rectangular configuration. A pair of rails are each situated over the ties in perpendicular relationship therewith and residing adjacent one of a pair of end faces thereof.

13 Claims, 1 Drawing Sheet

SYNTHETIC RAILROAD TIE

BACKGROUND OF THE INVENTION

1. Field of the Invention

The present invention relates to railroad ties and more particularly pertains to a new synthetic railroad tie for conserving wood while affording a superior tie or beam.

2. Description of the Prior Art

The use of railroad ties is known in the prior art. More specifically, railroad ties heretofore devised and utilized are known to consist basically of familiar, expected and obvious structural configurations, notwithstanding the myriad of designs encompassed by the crowded prior art which have been developed for the fulfillment of countless objectives and requirements.

Known prior art railroad ties include U.S. Pat. No. 4,286,753; U.S. Pat. No. 3,957,250; U.S. Pat. No. 3,950,873; U.S. Pat. No. 730,059; U.S. Pat. No. 4,357,772; and Foreign Patents EP 0 663 486 A1 and WO 95/26924 A1.

In these respects, the synthetic railroad tie according to the present invention substantially departs from the conventional concepts and designs of the prior art, and in so doing provides an apparatus primarily developed for the purpose of conserving wood while affording a superior tie or beam.

SUMMARY OF THE INVENTION

In view of the foregoing disadvantages inherent in the known types of railroad ties now present in the prior art, the present invention provides a new synthetic railroad tie construction wherein the same can be utilized for conserving wood while affording a superior tie or beam.

The general purpose of the present invention, which will be described subsequently in greater detail, is to provide a new synthetic railroad tie apparatus and method which has many of the advantages of the railroad ties mentioned heretofore and many novel features that result in a new synthetic railroad tie which is not anticipated, rendered obvious, suggested, or even implied by any of the prior art railroad ties, either alone or in any combination thereof.

To attain this, the present invention generally comprises a plurality of solid ties each constructed completely from plastic and having a rectangular configuration. Each tie has four equivalently sized and shaped rectangular side faces and a pair of square end faces, as shown in FIG. 1. It should further be noted that each tie has a constant square vertical cross-section along an entire length thereof. Also included is a plurality of rebars each formed from metal and having a length equal to that of each tie. As shown in FIG. 3, each rebar further includes a plurality of concentric annular flanges integrally coupled to a periphery thereof and extending outwardly therefrom. Four rebars are integrally formed within each tie adjacent to and along an associated one of four interconnections between a pair of the side faces of each tie. Associated therewith is a central rebar situated along a central axis of each tie. When the present invention is used in association with the rail road industry, a pair of rails are each situated over the ties in perpendicular relationship therewith. Such rails reside adjacent one of the end faces thereof. The side faces of the tie each have four sets of apertures formed therein. The four sets include two pairs of sets of apertures spaced a first distance apart equal to a width of the rails. Each pair of sets of apertures includes four apertures formed in a square configuration and extending a depth equal to ¼ that of the tie.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new synthetic railroad tie apparatus and method which has many of the advantages of the railroad ties mentioned heretofore and many novel features that result in a new synthetic railroad tie which is not anticipated, rendered obvious, suggested, or even implied by any of the prior art railroad ties, either alone or in any combination thereof.

It is another object of the present invention to provide a new synthetic railroad tie which may be easily and efficiently manufactured and marketed.

It is a further object of the present invention to provide a new synthetic railroad tie which is of a durable and reliable construction.

An even further object of the present invention is to provide a new synthetic railroad tie which is susceptible of a low cost of manufacture with regard to both materials and labor, and which accordingly is then susceptible of low prices of sale to the consuming public, thereby making such synthetic railroad tie economically available to the buying public.

Still yet another object of the present invention is to provide a new synthetic railroad tie which provides in the apparatuses and methods of the prior art some of the advantages thereof, while simultaneously overcoming some of the disadvantages normally associated therewith.

Still another object of the present invention is to provide a new synthetic railroad tie for conserving wood while affording a superior tie or beam.

Even still another object of the present invention is to provide a new synthetic railroad tie that includes a plurality of solid ties each constructed from plastic and having a rectangular configuration. A pair of rails are each situated over the ties in perpendicular relationship therewith and residing adjacent one of a pair of end faces thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
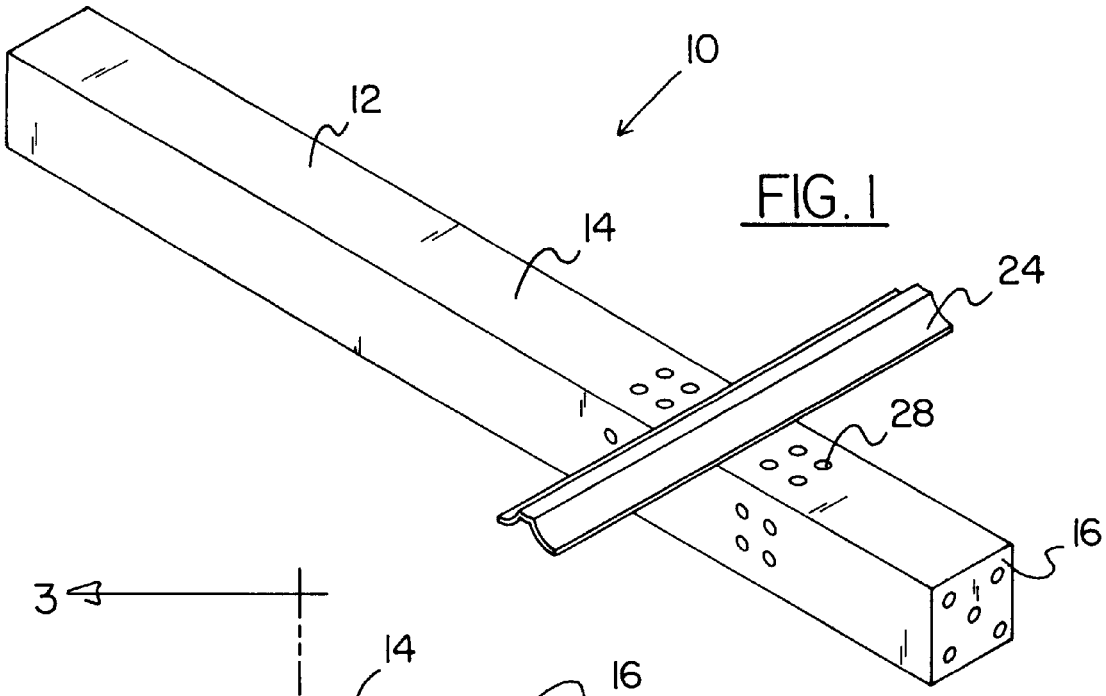
FIG. 1 is a perspective view of a new synthetic railroad tie according to the present invention.
Figure 2:
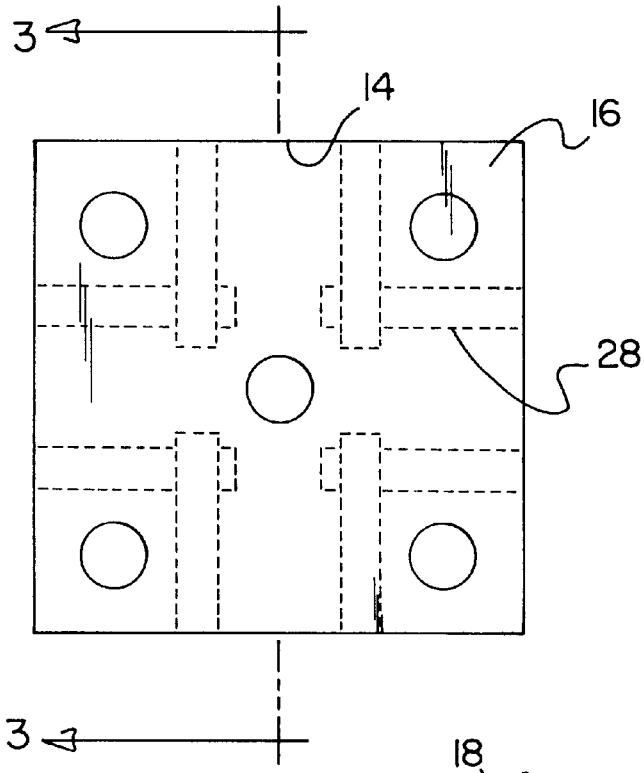
FIG. 2 is an end view of the present invention.
Figure 3:
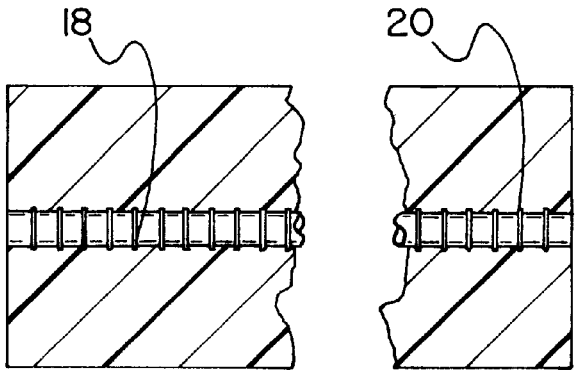
FIG. 3 is a cross-sectional view of the present invention taken along line 3—3 shown in FIG. 2.

With reference now to the drawings, and in particular to FIGS. 1 through 3 thereof, a new synthetic railroad tie embodying the principles and concepts of the present invention and generally designated by the reference numeral 10 will be described.

The present invention, designated as numeral 10, includes a plurality of solid ties 12 each constructed completely from plastic and having a rectangular configuration. Each tie has four equivalently sized and shaped rectangular side faces 14 and a pair of square end faces 16, as shown in FIG. 1. It should further be noted that each tie has a constant square vertical cross-section along an entire length thereof.

Also included is a plurality of rebars 18 each formed from metal and having a length equal to that of the associated tie. A cross-sectional area of each rebar is less than 1/15 that of the tie. In the preferred embodiment, a diameter of each rebar is about 1–2 inches. As shown in FIG. 3, each rebar further includes a plurality of concentric annular flanges 20 integrally coupled to a periphery thereof and extending outwardly therefrom. Four rebars are integrally formed within each tie adjacent to and along an associated one of four interconnections between a pair of the side faces of each tie. Associated therewith is a central rebar situated along a central axis of each tie.

When the present invention is used in association with the rail road industry, a pair of rails 24 are each situated over the ties in perpendicular relationship therewith. Such rails reside adjacent one of the end faces of each of the ties.

The side faces of each tie each have four sets of apertures 28 formed therein. The four sets each include two pairs of sets of apertures spaced a first distance apart equal to a width of the rails. Each pair of sets of apertures is situated adjacent to an associated one of the end faces of the corresponding tie. Further, each set of apertures includes four apertures formed in a square configuration and extending a depth equal to ¼ that of the tie. As shown in FIG. 2, an inboard end of each aperture resides in communication with that of a corresponding aperture of an adjacent face. During use, each set of apertures is adapted to initially receive a spike.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A synthetic railroad tie system comprising, in combination:

a plurality of solid ties each constructed completely from plastic and having a rectangular configuration, each tie having four equivalently sized and shaped rectangular side faces and a pair of square end faces, wherein each tie has a constant square vertical cross-section along an entire length thereof;

a plurality of rebars each formed from metal and having a length equal to that of each tie, each rebar further including a plurality of concentric annular flanges integrally coupled to a periphery thereof and extending outwardly therefrom, the rebars including four rebars integrally formed within each tie adjacent to and along an associated one of four interconnections between a pair of the side faces of each tie and a central rebar situated along a central axis of each tie; and a pair of rails each situated over the ties in perpendicular relationship therewith and residing adjacent one of the end faces thereof;

said side faces of the tie each having at least two sets of apertures formed therein, the apertures of a first one of the sets of apertures being spaced from the apertures of a second one of the sets by a first distance, the first distance being substantially equal to a width of the rails, each said set of apertures including four apertures formed in a square configuration and extending a depth equal to ¼ that of the tie, wherein an inboard end of each aperture resides in communication with that of a corresponding aperture of an adjacent face.

2. A synthetic railroad tie system comprising:

a plurality of solid ties, each of the ties being constructed from plastic and having a rectangular configuration, each of the ties, when it is placed in an operative position, being elongate with a pair of end faces and side faces extending between the end faces; and wherein each of the ties has four side faces with each of the side faces of being substantially rectangular in shape and being similarly sized to the other of the side faces, and wherein each of the end faces is substantially square in shape, wherein each tie has a substantially uniform cross-section along an entire length of the tie;

wherein each of said side faces of each of the ties has apertures formed therein; and wherein each of said side faces of said tie has at least two sets of apertures formed therein, the apertures of a first one of the sets of apertures being spaced from the apertures of a second one of the sets by a first distance, the first distance being substantially equal to a width of the rails.

3. A synthetic railroad tie system as set forth in claim 2 wherein a plurality of rebars each formed from metal are integrally formed within each tie along a length thereof.

4. A synthetic railroad tie system as set forth in claim 3 wherein the rebars include four rebars residing adjacent to and along an associated one of four interconnections between a pair of side faces of each tie and a central rebar is situated along a central axis of each tie.

5. A synthetic railroad tie system as set forth in claim 2 wherein each set of apertures includes four apertures formed in a square configuration.

6. A synthetic railroad tie system as set forth in claim 5 wherein each aperture extends a depth equal to ¼ that of the tie.

7. A synthetic railroad tie system comprising:

a plurality of solid ties, each of the ties being constructed from plastic and having a rectangular configuration, each of the ties, when it is placed in an operative position, being elongate with a pair of end faces and side faces extending between the end faces; and a pair of rails each situated over the ties in perpendicular relationship therewith and residing adjacent one of the end faces thereof;

wherein each of said side faces of the tie has apertures partially formed without extending to other of said side faces.

8. A synthetic railroad tie system as set forth in claim 7 wherein each tie has four equivalently sized and shaped rectangular side faces and a pair of square end faces, wherein each tie has a constant square vertical cross-section along an entire length thereof.

9. A synthetic railroad tie system as set forth in claim 7 wherein each of said side faces of said tie has at least two sets of apertures formed therein, the apertures of a first one of the sets of apertures being spaced from the apertures of a second one of the sets by a first distance, the first distance being substantially equal to a width of the rails.

10. A synthetic railroad tie system as set forth in claim 9 wherein each set of apertures include four apertures formed in a square configuration.

11. A synthetic railroad tie system as set forth in claim 7 wherein each aperture extends a depth equal to ¼ that of the tie.

12. A synthetic railroad tie system as set forth in claim 7 wherein a plurality of rebars each formed from metal are integrally formed within each tie along a length thereof.

13. A synthetic railroad tie system as set forth in claim 7 wherein the rebars includes four rebars residing adjacent to and along an associated one of four interconnections between a pair of side faces of each tie and a central rebar is situated along a central axis of each tie.

* * * * *